US006799953B2

(12) United States Patent
Nelson

(10) Patent No.: US 6,799,953 B2
(45) Date of Patent: Oct. 5, 2004

(54) PORT PLATE FOR AN AXIAL PISTON PUMP

(75) Inventor: Bryan E. Nelson, Lacon, IL (US)

(73) Assignee: Caterpillar Inc, Peoria, IL (US)

( * ) Notice: Subject to any disclaimer, the term of this patent is extended or adjusted under 35 U.S.C. 154(b) by 32 days.

(21) Appl. No.: 10/301,919

(22) Filed: Nov. 22, 2002

(65) Prior Publication Data

US 2004/0099247 A1 May 27, 2004

(51) Int. Cl.[7] ..... F04B 27/08; F01B 1/00; F02M 37/04

(52) U.S. Cl. ..... 417/269; 123/446; 123/506

(58) Field of Search ..... 417/269; 91/503; 92/157, 71; 123/446, 506

(56) References Cited

U.S. PATENT DOCUMENTS

| | | | | |
|---|---|---|---|---|
| 2,546,583 A | | 3/1951 | Born | |
| 2,757,612 A | | 8/1956 | Shaw | |
| 3,418,937 A | | 12/1968 | Cardillo et al. | |
| 3,982,630 A | * | 9/1976 | Garnier | 206/369 |
| 4,117,768 A | | 10/1978 | Affouard | |
| 4,627,793 A | | 12/1986 | Kuroyanagi et al. | |
| 4,880,361 A | | 11/1989 | Ikeda et al. | |
| 5,009,574 A | | 4/1991 | Ikeda et al. | |
| 5,022,310 A | | 6/1991 | Stewart et al. | |
| 5,085,127 A | | 2/1992 | Gantzer | |
| 5,634,776 A | | 6/1997 | Leemhuis et al. | |
| 5,733,105 A | | 3/1998 | Beckett et al. | |
| 5,931,644 A | | 8/1999 | Glassey et al. | |
| 6,035,828 A | | 3/2000 | Anderson et al. | |
| 6,055,809 A | | 5/2000 | Kishi et al. | |
| 6,179,574 B1 | | 1/2001 | Yie | |
| 6,644,277 B2 | * | 11/2003 | Blass et al. | 123/446 |

* cited by examiner

*Primary Examiner*—Charles G. Freay
(74) *Attorney, Agent, or Firm*—Finnegan, Henderson, Farabow, Garrett & Dunner

(57) ABSTRACT

A pump includes a stationary pump housing having a housing chamber, a rotating pump shaft having a central longitudinal axis and extending through a proximal end of the pump housing into the housing chamber, and a rotating swash plate fixed to the pump shaft. The swash plate includes a pump inlet passage with an opening in a surface of the rotating swash plate. A plurality of reciprocating pump pistons are also included with the pump, each pump piston is at least partially contained within a respective pump chamber formed in the stationary pump housing and has an axial bore extending completely therethrough. The axial bore of each pump piston may selectively communicate with the swash plate surface opening to permit the supply of inlet fluid to the axial bore from the inlet passage. A sealing plate substantially seals the swash plate surface opening from a flow of fluid into the inlet passage from the swash plate surface opening.

23 Claims, 6 Drawing Sheets

PORT PLATE FOR AN AXIAL PISTON PUMP

TECHNICAL FIELD

This invention relates generally to hydraulically-actuated systems used with internal combustion engines, and more particularly to an axial piston pump of a high pressure hydraulically-actuated system.

BACKGROUND

Axial piston pumps are known to be used in hydraulically-actuated fuel injection systems. The efficient operation of such pumps is significant to the overall operation of the engine. Moreover, the ability of such pumps to operate free of maintenance is important to reduce downtime of the system. While efficient operation is an important design criteria, issues such as weight, size, cost, and ease of assembly influence the overall design of such pumps.

U.S. Pat. No. 6,035,828 to Anderson et al. describes a fixed displacement, variable delivery axial piston pump for a hydraulically-actuated fuel injection system. In the system, a high pressure common rail supplies hydraulic working fluid to a plurality of hydraulically-actuated fuel injectors mounted in a diesel engine. The hydraulic fluid received in the common rail is pressurized by the fixed displacement axial piston pump that is driven directly by the engine. The pump includes a plurality of pistons disposed in parallel about a central longitudinal axis of the pump, and reciprocation of the pistons is achieved by the rotation of an angled camming surface or swash plate in continuous contact with the proximal ends of the pistons. The pump housing includes inlet and outlet check valves fluidly coupled to each pump chamber for allowing one way flow of hydraulic fluid into and out of the pump chambers during a pumping stroke of the piston. Displacement of the pump is varied by a control valve that selectively varies the amount of pressurized hydraulic fluid supplied to the pump outlet during the discharge stroke of each piston.

While the Anderson et al. pump performs well in operation, there remains room for improvement. For example, the use of inlet check valves may be too restrictive for effective flow of hydraulic fluid during the entire pump operation. During pump start-up, the inlet check valves may act to impede the flow of the hydraulic fluid because the fluid is colder and thus less viscous. This resistance of the flow of hydraulic fluid into the pump chamber can disrupt the necessary flow of fluid to the high pressure common rail and affect operation of the fuel injectors.

The present invention provides an axial piston pump that avoids some or all of the aforesaid shortcomings in the prior art.

SUMMARY OF THE INVENTION

In accordance with one aspect of the invention, a pump includes a stationary pump housing having a housing chamber and a pump shaft extending through a proximal end of the pump housing into the housing chamber and rotatable about a pump shaft longitudinal axis, and a swash plate connected to the pump shaft. The swash plate includes a pump inlet passage having an opening in a surface of the swash plate. A plurality of reciprocating pump pistons are also included with the pump, each pump piston at least partially contained within a respective pump chamber formed in the stationary pump housing and having an axial bore extending therethrough. The axial bore of each pump piston having selective communication with the swash plate surface opening to permit the supply of inlet fluid to the axial bore from the inlet passage. A sealing plate is included with the pump disposed between the swash plate and the plurality of pump pistons and substantially seals the swash plate surface opening from a flow of fluid into the inlet passage from the swash plate surface opening.

According to another aspect of the present invention, a method for reducing the required amount of fluid in a low pressure fluid reservoir located in a housing chamber of a pump includes orienting a pump housing of the pump so that a central longitudinal axis of a shaft of the pump extends substantially in a horizontal plane and providing an inlet passage in a rotating swash plate connected to the pump shaft. The method further includes receiving a low pressure fluid from the low pressure fluid reservoir through the inlet passage from a location elevationally below a first elevational level in the housing chamber and sealing a portion of the inlet passage so that the inlet passage does not receive fluid from above the first elevational level. Fluid is drawn from the low pressure fluid reservoir through the inlet passage and to an axial bore of at least one pump piston during a suction stroke of the at least one pump piston.

According to yet another aspect of the present invention, a hydraulically actuated system includes a pump having a rotating pump shaft having a central longitudinal axis, a rotating swash plate fixed to the pump shaft, and a plurality of non-rotating pump pistons. The pump pistons are at least partially located in pump chambers formed in a housing of the pump. The pump further includes an inlet passage formed in the swash plate having a radially inner opening and a radially outer opening formed in a surface of the swash plate, a sealing plate located between the surface of the swash plate and the plurality of pistons. The sealing plate covers the radially outer opening to block entry of fluid into the inlet passage from the radially outer opening. The pump further includes axial bores in each of the pump pistons for receiving fluid from the inlet passage. The system further includes a high pressure rail connected to the pump, at least one hydraulically actuated fuel injector connected to the high pressure rail, and an electronic control module in communication with and capable of controlling the fluid delivery control assembly.

DETAILED DESCRIPTION

Reference will now be made in detail to the drawings. Wherever possible, the same reference numbers will be used throughout the drawings to refer to the same or like parts.

Figure 1:
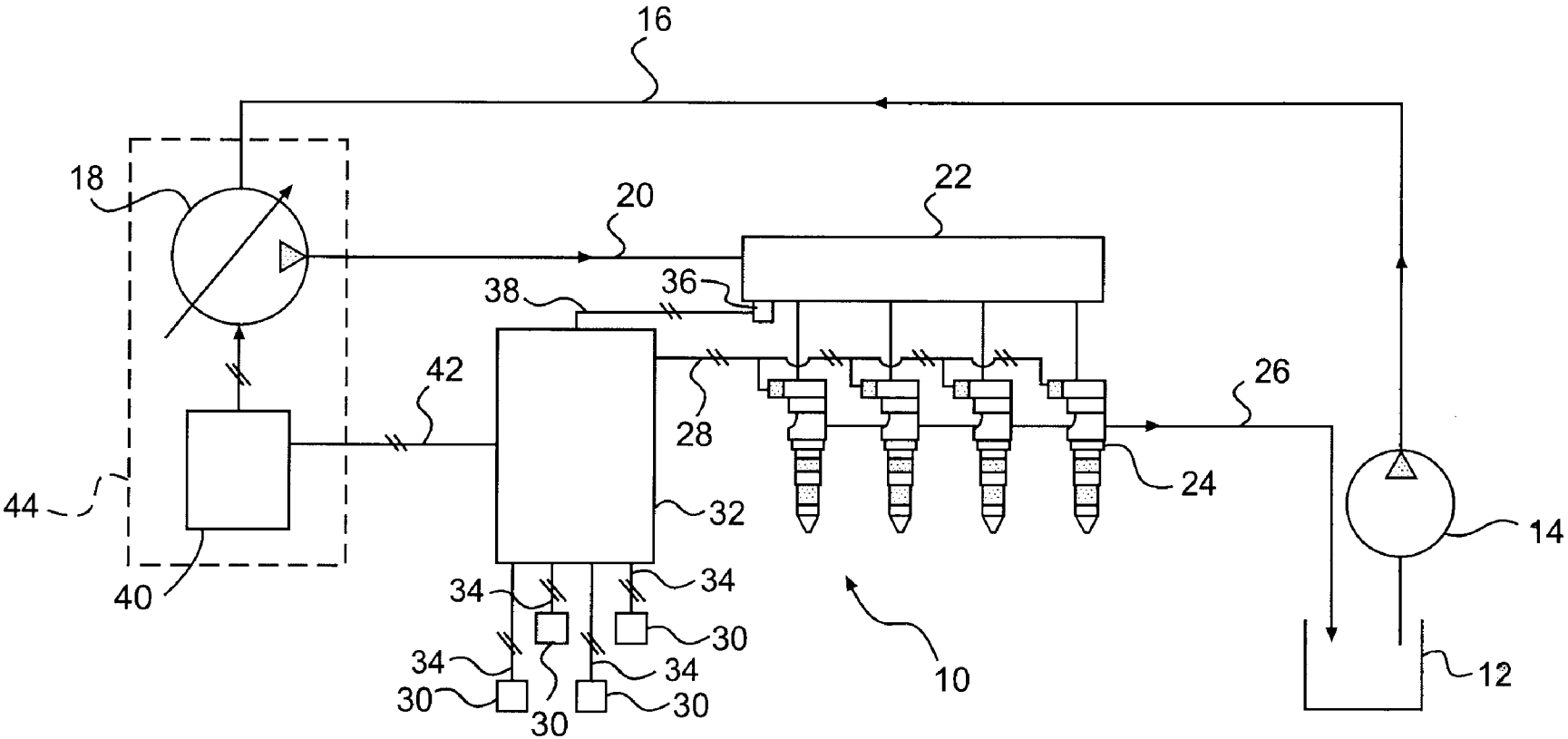
FIG. 1 is a schematic illustration of a hydraulically-actuated fuel injection system according to an exemplary embodiment of the present invention.

Referring now to FIG. 1, a working fluid circuit 10 for a hydraulically-actuated fuel injection system may make up a component of an internal combustion engine. Working fluid circuit 10 may include a source of low pressure working fluid 12, which may be, for example, the engine's lubricating oil sump. A supply pump 14 may supply working fluid through a low pressure supply line 16 to a high pressure axial piston pump 18. Axial piston pump 18 may then supply high pressure working fluid along high pressure supply line 20 to a high pressure common fluid rail 22. High pressure fluid rail 22 is fluidly connected to each of the fuel injectors 24 and selectively supplies high pressure working fluid to drive fuel injectors 24. After the high pressure working fluid is utilized by the individual fuel injectors 24, the working fluid may be returned to sump 12 via a drain passage 26.

As is well known in the art, the desired pressure in high pressure rail 22 is generally a function of the engine's operating condition. For instance, at high speeds and loads the rail pressure is generally desired to be significantly higher than the desired rail pressure when the engine is operating at an idle condition. A series of engine operating condition sensors 30 may be coupled to the engine at various locations to provide an electronic control module 32 with data through communication lines 34. Sensors 30 may detect engine parameters including, for example, engine speed, engine crankshaft position, engine coolant temperature, engine exhaust back pressure, air intake manifold pressure or throttle position. In addition, a pressure sensor 36 may provide electronic control module 32 with a measure of the fluid pressure in high pressure rail 22 via a communication line 38. The electronic control module 32 may be designed to compare a desired rail pressure, which is a function of the engine operating condition, with the actual rail pressure as measured by pressure sensor 36.

If the desired and measured rail pressures are different, the electronic control module 32 may command movement of a fluid delivery control assembly 40 via a communication line 42. The position of control assembly 40 determines the amount of working fluid that leaves pump 18 via high pressure supply line 20 and goes to high pressure rail 22. Both control assembly 40 and pump 18 may be contained in a single stationary pump housing 44. Further, electronic control module 32 may be coupled to each fuel injector 24 via communication line 28 to provide control signals to the working fluid valves of each fuel injector 24 to control the timing and duration of each fuel injection.

Figure 2:
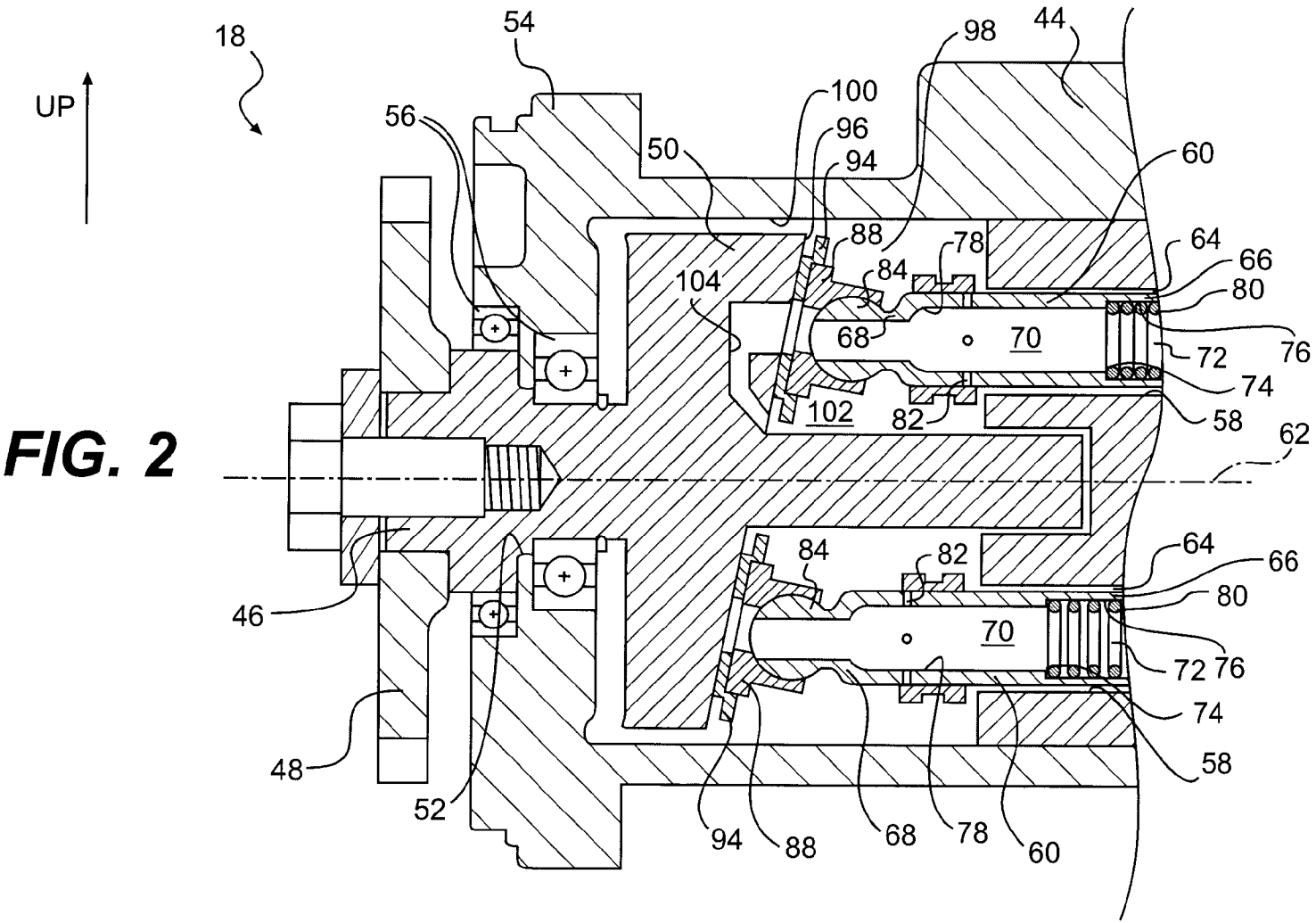
FIG. 2 is a partial cross-section diagrammatic view of an axial piston pump according to an exemplary embodiment of the present invention.

Referring now to FIG. 2, pump 18 may include a stationary pump housing 44 and a rotating shaft 46 coupled directly to the output of the engine by way of, for example, a gear 48, such that the rotation rate of shaft 46 is directly proportional to the rotation rate of the drive shaft (not shown) of the engine. A rotating, angled, fixed camming surface or swash plate 50 may be integrally formed or fixedly attached to shaft 46 so that shaft 46 and swash plate 50 rotate together. Shaft 46 may extend through an opening 52 in a proximal end 54 of stationary pump housing 44, and may be rotationally supported by pump housing 44 via a conventional bearing arrangement, such as bearing pair 56.

Stationary pump housing 44 may include a plurality of piston openings 58 for receiving portions of a plurality of pump pistons 60. For example, stationary pump housing 44 may include seven piston openings 58 receiving portions of seven pump pistons 60, the piston openings 58 being equally angularly spaced about a pump shaft longitudinal axis 62. Piston openings 58 may be sized and orientated to allow for reciprocating movement of pump pistons 60 parallel to pump shaft longitudinal axis 62. Gap 64 formed between a piston opening 58 and its respective pump piston 60 may be sealed in any conventional manner to restrict the flow of working fluid therethrough. The interaction of pump pistons 60 within stationary pump housing 44 prohibits pump pistons 60 from rotating with shaft 46 and swash plate 50.

Pump housing 44 may also include a plurality of additional passages associated with each piston opening 58. These additional passages may include a high pressure outlet passage (not shown) having a check valve, or other suitable mechanism, to provide one-way fluid flow of pressurized working fluid to high pressure supply line 20 (FIG. 1). The high pressure outlet passage may be formed in any conventional manner to provide for eventual connection with high pressure supply line 20.

Each pump piston 60 may be formed in a generally cylindrical shape having a distal portion 66, proximal portion 68 and an axial bore 70 extending completely through the pump piston 60 in a direction parallel to pump shaft longitudinal axis 62. Axial bore 70 forms, together with a distal portion of its respective piston opening 58, a pump chamber 72 for receiving working fluid and thereafter pressurizing the working fluid by a contraction of the pump chamber 72 as pump piston 60 moves distally toward a top-dead-center position. Distal portion 66 of pump piston 60 may be formed with a step 74 in axial bore 70 defining a transition between a distal greater diameter bore portion 76 and a proximal lesser diameter bore portion 78. Greater diameter bore portion 76 may contain a compression spring 80 secured between a distal portion of housing 44 (not shown) and step 74. Compression spring 80 may then act to continuously urge pump piston 60 proximally toward swash plate 50. Further, a plurality of radial ports 82 may extend from axial bore 70 radially though respective wall portions of pump pistons 60, the purposes of which will be described below.

Figure 3:
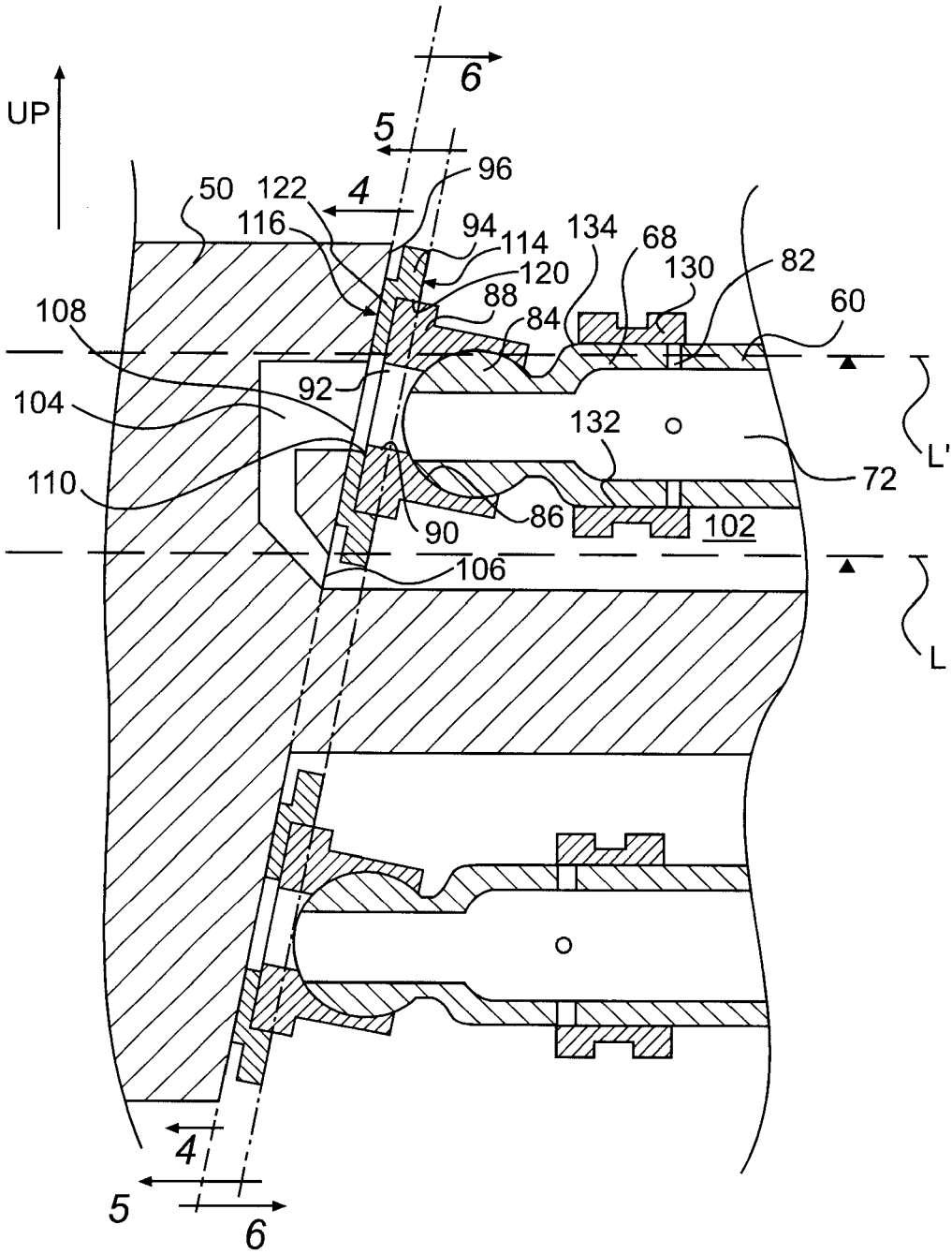
FIG. 3 is an enlarged diagrammatic view of the pump inlet illustrated in FIG. 2.

As shown by way of an enlarged piston assembly in FIG. 3, proximal portions 68 of pump pistons 60 may be formed with a spherically-shaped proximal or inlet end 84 so as to mate with a partially spherically-shaped recess 86 of a piston shoe 88. The mating of piston proximal end 84 with recess 86 of piston shoe 88 forms a ball-and-socket type coupling allowing for relative angular movement between pump piston 60 and piston shoe 88, but does not allow relative axial movement between the elements. Any other suitable coupling may be used to connect pump pistons 60 and piston shoes 88, so long as the coupling allows for angular relative movement and limited axial relative movement. Piston shoes 88 may also include a bore 90 extending from its proximal end 92 into recess 86. Bore 90 may be aligned to communicate with axial bore 70 of pump piston 60.

As will be described in more detail below, a sealing or port plate 94 may be coupled to piston shoes 88 between proximal ends 92 of pistons shoes 88 and a distal surface 96 of swash plate 50. Accordingly, stationary port plate 94 may form a bearing surface against distal surface 96 of rotating swash plate 50.

Referring back to FIG. 2, stationary pump housing 44 may include a housing chamber 98 for receiving pump pistons 60, piston shoes 88, port plate 94 and a portion of shaft 46. A side surface 100 of housing chamber 98 may form a circular cross-section of a dimension slightly larger than a diameter of rotating swash plate 50 so as to allow rotation of swash plate 50 in housing chamber 98. Housing chamber 98 may be coupled to, and receive working fluid from, low pressure supply line 16 (FIG. 1) to form a low pressure fluid reservoir 102. Low pressure reservoir 102 may serve as the inlet fluid source for pump chambers 72. Orientation of pump shaft longitudinal axis 62 in a horizontal plane, and filling of low pressure fluid reservoir 102 with the minimum required amount of working fluid, may result in a fluid level (L) shown in dotted lines in FIG. 3.

Swash plate 50 may include an inlet passage 104 allowing fluid communication between low pressure reservoir 102 and pump chamber 72 of each pump piston 60. In the exemplary embodiment illustrated in FIG. 3, inlet passage 104 extends from a radially inner opening 106 in swash plate distal surface 96, through swash plate 50, to a radially outer opening 108 in swash plate distal surface 96. Radially inner and outer openings 106, 108 may be formed in an arcuate shape (FIG. 4), or any other suitable shape. Inlet passage 104 provides fluid communication between low pressure fluid reservoir 102 and axial bore 70 by way of a hole or bore 110 extending through port plate 94 and aligned with swash plate outer opening 108, and bore 90 of piston shoe 88. Outer opening 108 may be angularly positioned about swash plate 50 so as to communicate with an axial bore 70 of a pump piston 60 only during a suction stroke of each pump piston 60. Inlet passage 104 may be formed in any other suitable shape, size or manner allowing for the flow of working fluid from low pressure fluid reservoir 102 of housing chamber 98 to bore 110 of port plate 94.

Figure 5:
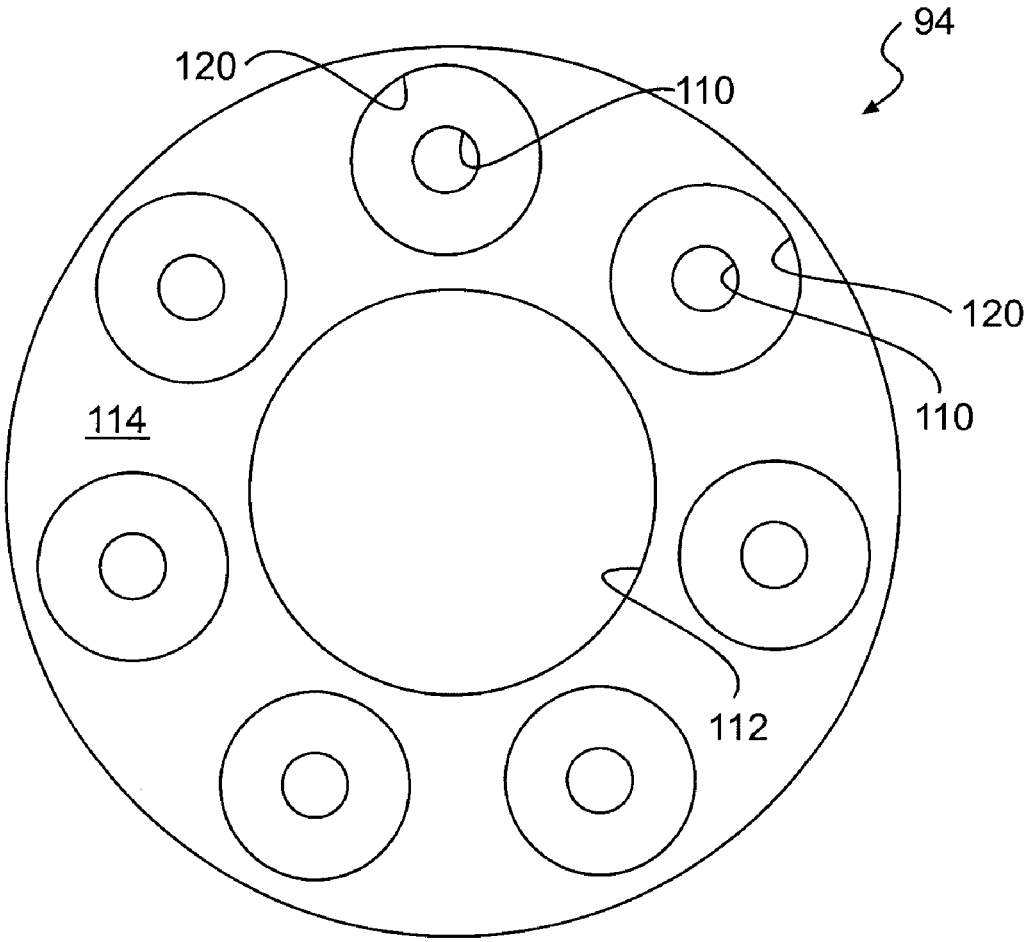
FIG. 5 is a diagrammatic plan view of a proximal end of the axial piston pump taken at section 5—5 of FIG. 3.
Figure 6:
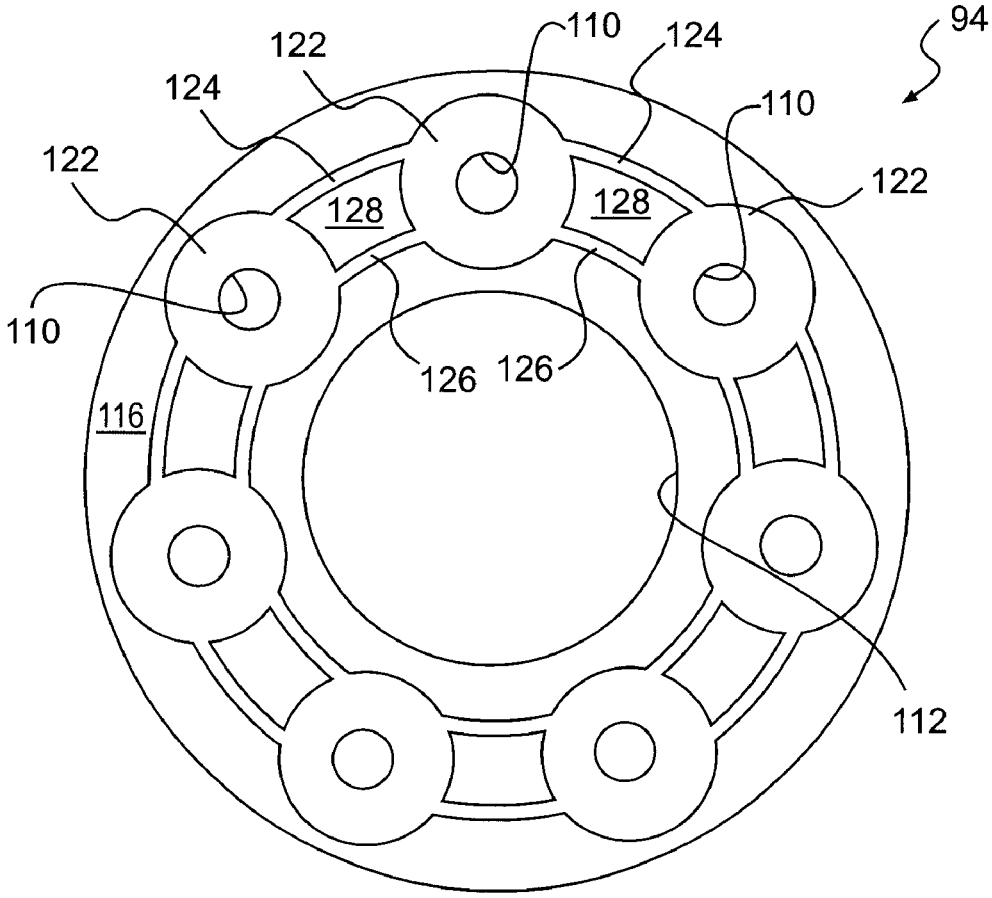
FIG. 6 is a diagrammatic plan view of a proximal end of the axial piston pump taken at section 6—6 of FIG. 3.

Turning to FIGS. 5 and 6, FIG. 5 illustrates a distal side 114 of port plate 94, while FIG. 6 illustrates a proximal side 116 thereof. Port plate 94 may be formed in a generally circular shape having a maximum diameter the same or slightly smaller or larger than the maximum diameter of swash plate 50. Port plate 94 may also include a central bore 112 for allowing shaft 46 to extend therethrough. Further, central bore 112 may be sized not to cover inner opening 106 formed in distal surface 96 of swash plate 50. As noted above, port plate 94 may include a plurality of bores 110. Bores 110 may be equally radially and angularly spaced about central bore 112 and located to align with bores 90 of each piston shoe 88. As shown in FIG. 5, distal side 114 of port plate 94 may include a circular depression, recess or cavity 120 formed around each bore 110 and sized to be slightly larger than a maximum diameter of proximal end 92 of piston shoes 88. Accordingly, circular cavities 120 may form a recessed seat for receiving distal end 92 of each piston shoe 88.

Figure 4:
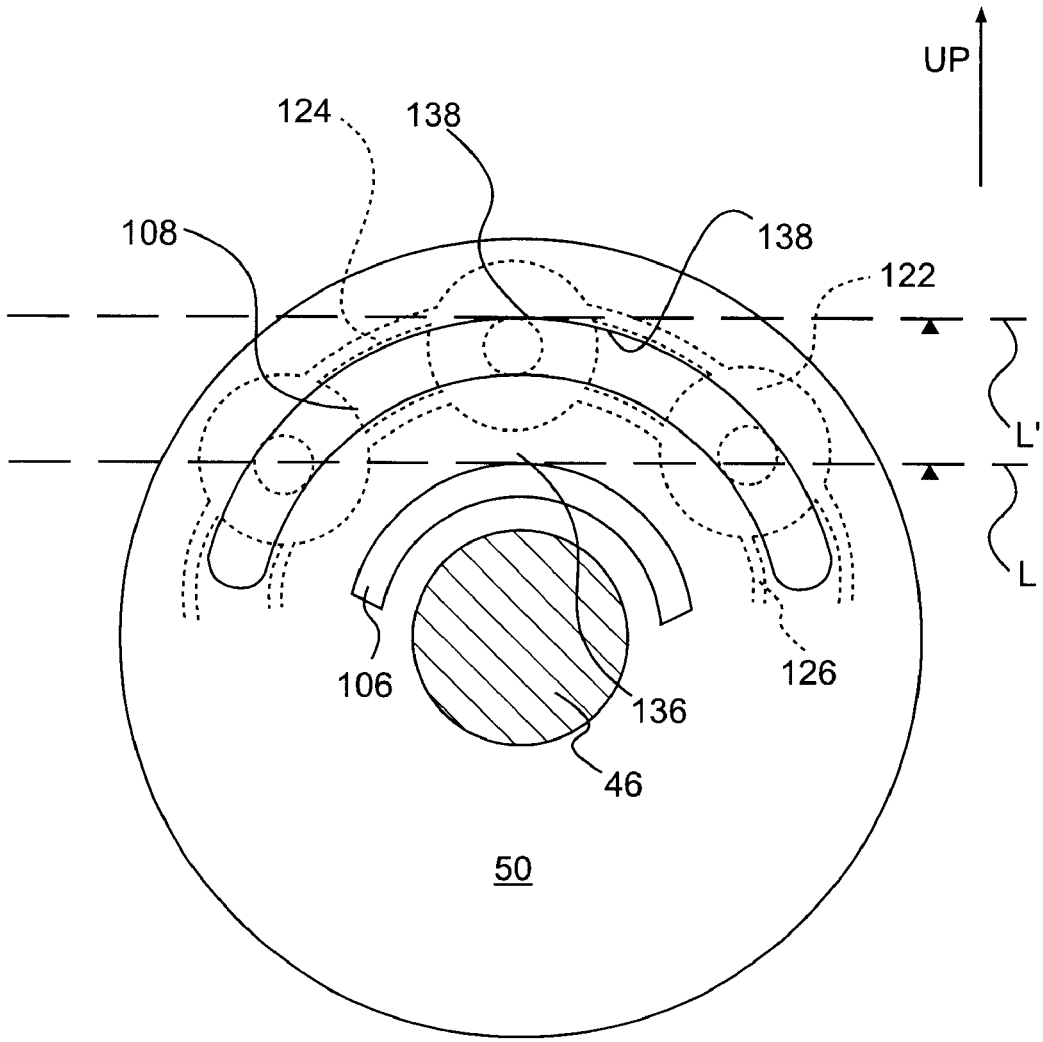
FIG. 4 is a diagrammatic plan view of a proximal end of the axial piston pump taken at section 4—4 of FIG. 3.

Proximal side 116 of port plate 94 (FIG. 6) may include a circular protrusion 122 surrounding each bore 110. A relatively thin radial outer curved protrusion 124 and a relatively thin radial inner curved protrusion 126 may connect each circular protrusion 122. A sealing chamber 128 is thus formed on proximal side 116 of port plate 94 between the interconnected circular protrusion 122, radial outer curved protrusion 124 and radial inner curved protrusion 126. Protrusions 122, 124 and 126 together form a bearing area against distal surface 96 of swash plate 50 which has an outer extent that substantially completely surrounds the radially outer opening 108 in swash plate 50 (FIG. 4).

Stationary pump housing 44 may also receive a control lever (not shown) coupled to a control sleeve 130 (FIG. 3). Control sleeve 130 may include bores 132 extending therethrough aligned with each pump piston 60 so as to slide axially along a portion of an outer surface 134 of each pump piston 60 in the vicinity of radial ports 82. As will be described in more detail below, control sleeve 130 covers or uncovers radial ports 82 in pump piston 60 based on actuation of the control lever in a proximal or distal direction.

Industrial Applicability

In operation, rotation of the drive shaft of engine causes rotation of shaft 46 of pump 18. This rotation of shaft 46 acts to rotate swash plate 50 and reciprocate pump pistons 60 in a direction parallel to pump shaft longitudinal axis 62. Reciprocation of pump pistons 60 is obtained because compression spring 80 urges each pump piston 60 against a rotating, profiled distal surface 96 of swash plate 50. The profile formed on distal surface 96 of swash plate 50 defines the extent to which swash plate 50 extends in a distal direction at a specified angular position. Accordingly, the location of inlet passage 104 and the profile of swash plate 50 are coordinated so that axial bores 70 of pump pistons 60 communicate with inlet passage 104 only during specified angular positions of swash plate 50. In particular, inlet passage 104 may be in communication with axial bores 70 of pump pistons 60 when the profile of swash plate 50 urges pump pistons 60 proximally to expand pumping chamber 72 to draw in working fluid from low pressure fluid reservoir 102. Inlet passage 104 may be out of communication with an axial bore 70 of a pump piston 60, thus sealing off a proximal end of axial bore 70, when the profile of swash plate 50 urges pump piston 60 distally to contract pumping chamber 72 and pressurize the working fluid in pumping chamber 72.

Referring to FIGS. 3 and 4 and as noted above, working fluid is fed into an axial bore 70 from low pressure fluid reservoir 102 through an inlet flow path. Inlet flow path may include inlet passage 104 of swash plate 50, bore 110 of port plate 94, and bore 90 of piston shoe 88. With this inlet flow path, the minimum level (L) of low pressure fluid reservoir 102 should be maintained above an uppermost and radially outermost portion 136 of swash plate radially inner opening 106. This ensures that inner radial opening 106 is submerged in low pressure reservoir 102 during the entire rotation of swash plate 50, and thus only working fluid is fed through the inlet flow path into axial bore 70.

The minimum level (L) shown in FIGS. 3 and 4 is possible due to the existence of port plate 94. Without port plate 94, a level L' (shown in dashed lines) of working fluid in low pressure fluid reservoir 102 would be required. Fluid level line L' corresponds to an uppermost and radially outermost portion 138 of swash plate outer opening 108. A level L'of working fluid would be required because outer opening 108 would be in fluid communication with housing chamber 98 in the spaces between piston shoes 88. With the inclusion of port plate 94, sealing chamber 128 seals outer opening 108 from fluid communication with housing chamber 98. As shown in dashed lines in FIG. 4, sealing chamber 128 is formed by circular protrusion 122, radial outer curved protrusion 124 and radial inner curved protrusion 126 bearing against swash plate 50 to seal outer opening 108. Accordingly, fluid cannot enter inlet passage 104 except through radially inner opening 106. Accordingly, the minimum level (L) of the working fluid required is reduced through the use of port plate 84. Friction forces resulting from the contact of rotating swash plate 50 and stationary port plate 84 are also reduced by minimizing the contact area between the elements due to the relatively thin curved protrusions 124, 126.

Providing pump 18 with a lower minimum level (L) of working fluid reduces the required size of fluid reservoir 102 resulting in space savings for pump 18. The minimum level (L) of working fluid is most important during pump start-up, when the level of the reservoir may be at its lowest and a full flow of working fluid from low pressure supply conduit 24 to reservoir 102 has not yet begun.

Once working fluid has been received in pump chamber 72, inlet passage 104 is rotated out of communication with pump chamber 72 and the profile of swash plate 50 causes pump piston 60 to move distally to contract pump chamber 72 and pressurize the working fluid contained therein. Some of the pressurized working fluid is then expelled through a high pressure outlet passage (not shown) to high pressure supply line 20 (FIG. 1) and then to high pressure rail 22 (FIG. 1).

If a desired fluid pressure in rail 14 is different than the actual pressure in rail 14, the amount of high pressure fluid leaving pump 18 may be varied by control assembly 40. Control assembly 40 may include the control lever (not shown) and control sleeve 130. If electric control module 32 determines that pump 18 is supplying excess working fluid through high pressure supply line 20 to rail 22, a signal may be sent along communication line 42 to control assembly 40 to move the control lever to move control sleeve 130 so that radial ports 82 of pump pistons 60 are uncovered at some point during contraction of pump chamber 72. Once radial ports 82 are uncovered, pressurized fluid within pump chamber 72 is expelled to housing chamber 98 rather than through the high pressure outlet passages. Thus, the position of control sleeve 130 on pump piston 60 controls the amount of working fluid that is pressurized and forced from pump chamber 72 to high pressure supply conduit 24.

Other embodiments of the invention will be apparent to those skilled in the art from consideration of the specification and practice of the invention disclosed herein. For example, port plate 94 and piston shoes 88 may be formed as separate elements or as one integral element. Further, circular protrusion 122, radially outer protrusion 124 and radially inner protrusion 126 may be formed in other configurations so long as they form an appropriate seal around outer opening 108. Even further, port plate 84 may be used in connection with a variable displacement pump, such as a pump having control of the tilt angle of its rotating swash plate. It is intended that the specification and examples be considered as exemplary only, with a true scope of the invention being indicated by the following claims.

What is claimed is:

1. A pump comprising:

a stationary pump housing having a housing chamber;

a pump shaft extending through a proximal end of the pump housing into the housing chamber and rotatable about a pump shaft longitudinal axis;

a swash plate connected to the pump shaft, the swash plate having a pump inlet passage having an opening in a surface of the swash plate;

a plurality of reciprocating pump pistons, each pump piston at least partially contained within a respective pump chamber formed in the stationary pump housing and having an axial bore extending therethrough, the axial bore of each pump piston having selective communication with the swash plate surface opening to permit the supply of inlet fluid to the axial bore from the inlet passage; and a sealing plate disposed between the swash plate and the plurality of pump pistons and substantially sealing the swash plate surface opening from a flow of fluid into the inlet passage from the swash plate surface opening.

2. The pump according to claim 1, wherein the swash plate surface opening forms a radially outer opening and the inlet passage includes a radially inner opening connecting the inlet passage to the housing chamber, and the sealing plate seals the radially outer opening so that the axial bores of the pump pistons only receive inlet fluid flowing from the housing chamber through the radially inner opening of the inlet passage.

3. The pump according to claim 2, wherein the radially inner opening is located on said surface of the swash plate.

4. The pump according to claim 1, wherein the sealing plate includes a plurality of holes extending therethrough, each sealing plate hole being aligned with a respective said axial bore of a pump piston.

5. The pump according to claim 4, wherein the sealing plate includes a proximal side adjacent said surface of the swash plate and a distal side adjacent the proximal ends of the pump pistons, wherein the proximal side of the sealing plate includes interconnected protrusions together forming a bearing area against said surface of the swash plate, an outer extent of the bearing area substantially completely surrounding the swash plate surface opening.

6. The pump according to claim 5, wherein the distal side of the sealing plate includes a plurality of recesses, each recess sized to receive a piston shoe connected to a respective said proximal end of a pump piston, the piston shoes each having a hole for allowing flow of fluid between respective said sealing plate holes and axial bores of the pump pistons.

7. The pump according to claim 1, wherein the plurality of pump pistons each extend generally parallel to the pump shaft longitudinal axis.

8. The pump according to claim 7, further including a delivery control assembly having a plurality of slidable sleeves, each slidable sleeve located on a respective pump piston and controllably positionable to uncover a port in the pump piston that is fluidly connected to the axial bore of the pump piston.

9. A method for reducing the required amount of fluid in a low pressure fluid reservoir located in a housing chamber of a pump, comprising:

orienting a pump housing of the pump so that a central longitudinal axis of a shaft of the pump extends substantially in a horizontal plane;

providing an inlet passage in a rotating swash plate connected to the pump shaft;

receiving a low pressure fluid from the low pressure fluid reservoir through the inlet passage from a location elevationally below a first elevational level in the housing chamber;

sealing a portion of the inlet passage so that the inlet passage does not receive fluid from above the first elevational level; and drawing fluid from the low pressure fluid reservoir through the inlet passage and to an axial bore of at least one pump piston during a suction stroke of the at least one pump piston.

10. The method for reducing the required amount of fluid in a low pressure reservoir according to claim 9, wherein the inlet passage includes a radially inner opening and a radially outer opening formed in a surface of the swash plate, and the first elevational level corresponds to a level sufficient to submerge the radially inner opening in the low pressure reservoir during an entire rotation of the swash plate.

11. The method for reducing the required amount of fluid in a low pressure reservoir according to claim 10, wherein the sealing step includes providing a sealing plate covering the radially outer opening.

12. The method for reducing the required amount of fluid in a low pressure reservoir according to claim 11, wherein the sealing plate is located between said surface of the swash plate and an inlet end of a plurality of said at least one pump piston.

13. The method for reducing the required amount of fluid in a low pressure reservoir according to claim 12, wherein the sealing plate includes a plurality of holes extending therethrough, each sealing plate hole being aligned with a respective axial bore of a pump piston.

14. The method for reducing the required amount of fluid in a low pressure reservoir according to claim 13, wherein the sealing plate includes a side adjacent said surface of the swash plate and a side adjacent the inlet ends of the pump pistons, wherein the swash plate side of the sealing plate includes interconnected protrusions together forming a bearing area against said surface of the swash plate, an outer extent of the bearing area substantially completely surrounding the radially outer opening.

15. The method for reducing the required amount of fluid in a low pressure reservoir according to claim 14, wherein the side of the sealing plate adjacent the inlet ends of the pump pistons includes a plurality of recesses, each recess sized to receive a piston shoe connected to a respective said inlet end of a pump piston, the piston shoes each having a hole for allowing flow of fluid between respective said sealing plate holes and axial bores of the pump pistons.

16. The method for reducing the required amount of fluid in a low pressure reservoir according to claim 9, further including a plurality of said at least one pump piston and the plurality of pump pistons each extend generally parallel to the central longitudinal axis of the pump shaft.

17. The method for reducing the required amount of fluid in a low pressure reservoir according to claim 16, further including a delivery control assembly having a plurality of slidable sleeves, each slidable sleeve located on a respective pump piston and controllably positionable to uncover a port in the pump piston that is fluidly connected to the axial bore of the pump piston.

18. A hydraulically actuated system, comprising:

a pump having a rotating pump shaft having a central longitudinal axis, a swash plate connected to the pump shaft, a plurality of pump pistons at least partially located in pump chambers formed in a housing of the pump, an inlet passage formed in the swash plate having a radially inner opening and a radially outer opening formed in a surface of the swash plate, a sealing plate located between said surface of the swash plate and the plurality of pistons and covering the radially outer opening to block entry of fluid into the inlet passage from the radially outer opening, and axial bores in each of the pump pistons for receiving fluid from the inlet passage;

a high pressure rail connected to the pump;

at least one hydraulically actuated fuel injector connected to the high pressure rail; and an electronic control module in communication with and capable of controlling the fluid delivery control assembly.

19. The hydraulically actuated system according to claim 18, wherein the sealing plate includes a plurality of holes extending therethrough, each sealing plate hole being aligned with a respective said axial bore of a pump piston.

20. The hydraulically actuated system according to claim 19, wherein the sealing plate includes a proximal side adjacent said surface of the swash plate and a distal side adjacent the inlet ends of the pump pistons, wherein the proximal side of the sealing plate includes interconnected protrusions together forming a bearing area against said surface of the swash plate, an outer extent of the bearing area substantially completely surrounding the swash plate surface opening.

21. The hydraulically actuated system according to claim 20, wherein the distal side of the sealing plate includes a plurality of recesses, each recess sized to receive a piston shoe connected to a respective said inlet end of a pump piston, the piston shoes each having a hole for allowing flow of fluid between respective said sealing plate holes and axial bores of the pump pistons.

22. The hydraulically actuated system according to claim 18, wherein the plurality of pump pistons each extend generally parallel to the central longitudinal axis of the pump axis.

23. The hydraulically actuated system according to claim 22, wherein the pump delivery control assembly includes a plurality of slidable sleeves, each slidable sleeve located on a respective pump piston and controllably positionable to uncover a port in the pump piston that is fluidly connected to a respective pump chamber of the pump piston.

* * * * *